United States Patent [19]

Shimizu

[11] Patent Number: 4,506,707

[45] Date of Patent: Mar. 26, 1985

[54] HEDDLE FRAME

[75] Inventor: Yoichi Shimizu, Izumishi, Japan

[73] Assignee: Kabushiki Kaisha Maruyama Seisakusho, Sakaishi, Japan

[21] Appl. No.: 515,455

[22] Filed: Jul. 20, 1983

[51] Int. Cl.[3] ..... D03C 9/06

[52] U.S. Cl. ..... 139/91

[58] Field of Search ..... 139/91, 92

[56] References Cited

U.S. PATENT DOCUMENTS 643,509 2/1900 Lackey ..... 139/92

954,013 5/1910 Barlow ..... 139/92

FOREIGN PATENT DOCUMENTS 72449 2/1983 European Pat. Off. ..... 139/91

*Primary Examiner*—Henry S. Jaudon

*Attorney, Agent, or Firm*—Oblon, Fisher, Spivak, McClelland & Maier

[57] ABSTRACT

A heddle frame in which the heddles have enlarged heads which are slidably mounted in guide channels in the side beams. To remove the heddles the heads are slid longitudinally in the guide channels until they come to a channel opening port which permits them to be removed transversely to the guide channels.

8 Claims, 7 Drawing Figures

HEDDLE FRAME

FIELD OF THE INVENTION

This invention relates generally to looms. In particular, it relates to heddle frames used to guide warp threads in looms.

BACKGROUND OF THE INVENTION

FIG. 1 is an elevational view of a conventional heddle frame. In this drawing, numeral 1 indicates side beams which are arranged horizontally and parallel to each other, 2 indicates side stays which fix the ends of the side beams 1, and 3 indicates heddle bars, one of which is connected to each of the side beams 1 through hooks 4 and hook hangers 4'. Heddles 5 are attached to the heddle bars 3 at determined intervals by fitting parts 6.

The conventional heddle frame shown in FIG. 1 suffers from a number of drawbacks. First, there are numerous parts. It is necessary to manufacture the heddle bars 3, hooks 4, hook hangers 4', and the fitting parts 6, making the structure complicated and requiring a great deal of assembly time, as well as making the structure larger and heavier than would be desirable. Further, the conventional heddle frame is very noisy, since the vibrations of the heddles are transferred to the heddle frame during operation. Finally, the heddles 5 cannot be replaced even if the side stays 2 are removed, because the heddle bars 3 are connected to the side beams 1 by the hangers 4.

OBJECTS OF THE INVENTION

It is the principle object of this invention to ameliorate or overcome one or more of the above disadvantages of the conventional structure. In particular, it is the object of this invention to offer a heddle frame which provides one or more of the following features: (1) the heddles may be hung between the side beams without the use of heddle bars, hooks, hook hangers, etc.; (2) the heddles may be quickly and easily assembled in and taken out of position between the side beams; (3) the overall heddle frame is lighter than conventional heddle frames; (4) the side beams themselves are lighter than in conventional heddle frames; and (5) operation of the heddle frame is less noisy than has been the case with conventional heddle frames.

SUMMARY OF THE INVENTION

A heddle frame in accordance with this invention includes a pair of spaced side beams, each of which has a hollow guide channel in the interior and a slit opening extending from the hollow guide channel to the interior face of the side beam. A plurality of heddles are disposed between the spaced side beams. Each of the heddles has a head at each end which is received in the associated one of the hollow guide channels but which is sized and shaped such that it will not pass through the slit opening. A hole is formed in each of the heads in the longitudinal direction of the hollow guide channel. A wire rod is disposed in each of the hollow guide channels and passes through the holes in the heads of the heddles.

DETAILED DESCRIPTION OF THE PRESENTLY PREFERRED EMBODIMENT

Figure 1:
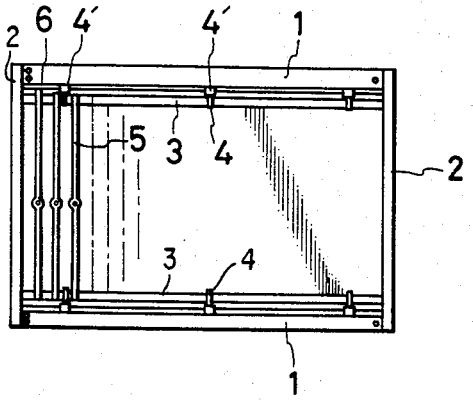
FiG.1 PRIOR ART
FIG. 1 is an elevational view of the conventional heddle frame.
Figure 2:
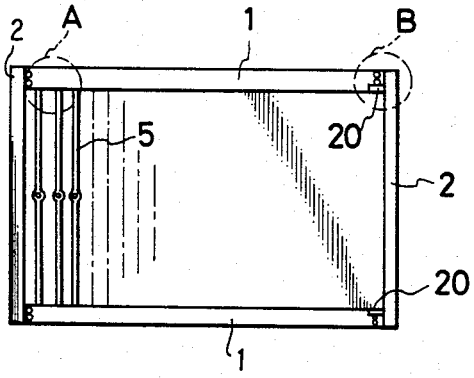
FIG. 2 is a elevational view of a heddle frame in accordance with the subject invention.

FIG. 2 is a general elevational view of a heddle frame in accordance with the subject invention. The same numbers as were used in describing the prior art heddle frame shown in FIG. 1 are used to denominate the same or similar parts. That is, the numerals 1 designate the side beams, the numerals 2 designate the side stays, and the numerals 5 designate the heddles.

Figure 3:
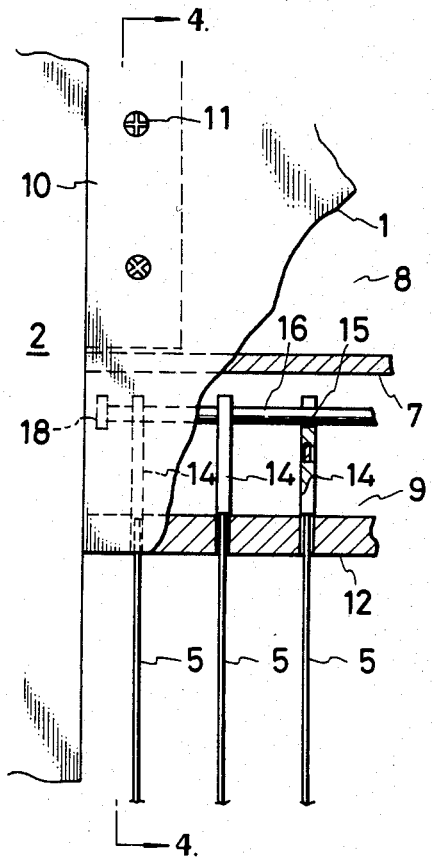
FIG. 3 is a partially sectional view of the portion of FIG. 2 within the circle A on an enlarged scale.
Figure 4:
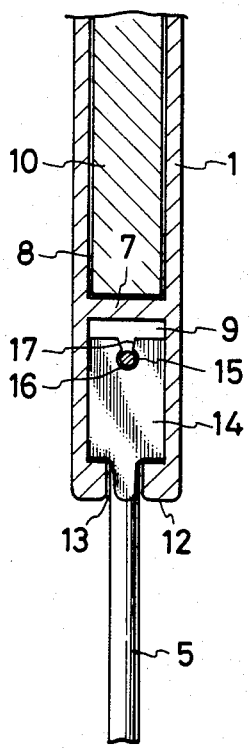
FIG. 4 is a cross-sectional view along the line 4—4 in FIG. 3.

Turning to FIGS. 3 and 4, it will be seen that the side beams 1 are made from long plate material which is hollow to reduce its weight. The interior of each side beam 1 is partitioned by a partition wall 7, which also serves as a reinforcing member. On one side of the partition wall 7 is a hollow volume 8, and on the other side of the partition wall 7 is a longitudinal hollow guide channel 9. Projecting pieces 10 are attached to the inner faces of the ends of the side stays 2. The projecting pieces 10 are fitted into the end openings of the hollow volumes 8 in the side beams 1 and are preferably fixed to the side walls of the side beams 1 with set screws 11. Various methods of attaching side beams 1 and the side stays 2 can be employed other than the combination of projecting pieces 10 and the set screws 11. However, a method which allows simple removal of the side stays as necessary is desirable.

A longitudinal slit opening 13 is formed in the side beams 1, providing communication between the inside end face 12 of each side beam 1 and the guide channel 9. Although this sectional configuration may appear somewhat complicated, the side beams 1 may be easily made by extrusion from aluminum or the like.

The numeral 14 designates heads which are attached to each end of the heddles 5 and which are engaged in the guide channels 9 with their faces perpendicular to the longitudinal direction of the guides channels 9, as is shown in FIG. 4. The heads 14 are sized and shaped such that they will not pass through the slit openings 13, but permit the heddles 5 to be moved longitudinally relative to the side beams 1.

Figure 6:
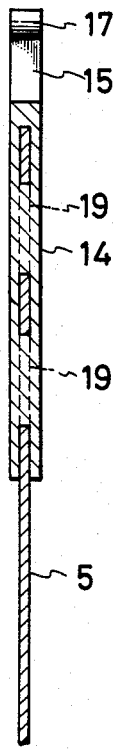
FIG. 6 is a cross-sectional view of along the line 6—6 in FIG. 5.

Numeral 15 designates holes formed in the heads 14 in the direction of the longitudinally extending guide channel 9. A wire rod 16 is disposed in each of the guide channels 9 and passes through the holes 15. The wire rod 16 is not attached to the side beams 1, but is free to move relative to the side beams 1 both vertically and longitudinally. However, the wire rod 16 and the inner faces of the side beams 1 prevent the heddles 5 from moving in the direction perpendicular to the plane of FIG. 3, and the wire rod 16 also prevents rotation, or cocking, of the heads 14 in the guide channels 9 around the center of the axis of the associated heddle 5 during operation of the heddle frame. (Since, as shown in FIG. 6, the heads 14 are quite thin in cross section in the direction parallel to the longitudinal axis of the guide channels 9, and since there is considerable space between the edges of the heads 14 and the inner faces of the guide channel 9 to permit easy sliding of the heads 14 relative to the guide channel 9, the heads 14 (and thus the heddles 5) might rotate to a considerable degree in the absence of wire rod 16.)

Figure 5:
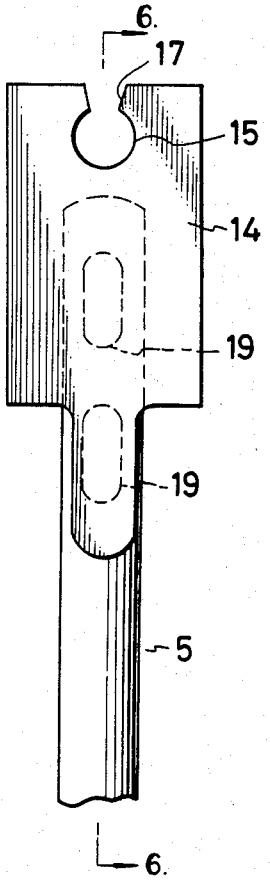
FIG. 5 is a fragmentary elevational view of a portion of a heddle adapted for use in the subject invention.

The holes 15 are preferably notched as shown in FIG. 5. That is, a V-shaped notch 17 opens to the top of the heads 14 to permit the heddles 5 to be put on and taken off the wire rod 16 without passing over the ends of the wire rod 16. The heads 14 are preferably made of resilient plastic, and the cross-sectional area of the notches 17 is preferably less than the cross-sectional area of the wire rod 16, permitting the wire rod 16 to be pushed through the notches 17 against the resilience of the heads 14 and held in place on the wire rod 16.

Numeral 18 designates a stopper which is carried by each end of the wire rod 16. As shown in FIG. 4, the stoppers 18 are sized and shaped so that they will not pass through the holes 15, so that the wire rod 16 will not slide out through the holes 15 even if the wire rod 16 is pulled.

The wire rod 16 can be made of aluminum, steel, resin, etc., and its sectional form can be arbitrarily formed to suit to the holes 15 in the heads 14. The heddles 5 are generally made of high tension steel or stainless steel, and the side beams 1 are also made of metallic material, such as aluminum. Therefore, if the heads 14 are made of metallic material, although the noise is smaller than that of conventional heddle frames, noise caused by mutual contact of metals is apt to be generated during the operation of the heddle frame. Therefore, the heads 14 are desirably made of plastic materials, thereby avoiding contact of metal with metal and decreasing the noise as much as possible. Moreover, when the heads are made of plastics, the impact force from the vibration, swing, etc., of the heddle frame during operation is absorbed by the elasticity of the plastic to a considerable degree, rather than being transferred to the heddles 5, decreasing breakage of the heddles 5 and cutting of the weft.

FIG. 5 is an elevational view of the end part of a heddle 5 attached to a plastic head 14, and FIG. 6 is a sectional view along the line 6—6 in FIG. 5. To make the head 14 of plastic, punched holes 19 as shown by dotted lines are formed in the end of the heddle 5, which is made of high tension steel or stainless steel. The end of the heddle 5 is inserted into a die in the form of the head 14, and the head 14 is molded to the end of the heddle 5 as one body. As shown in FIG. 6, the head 14 is fixed securely to the heddle 5 by the plastic molded in punched holes 19.

The form of the head 14 is not necessarily limited to the form as shown in the drawings, but it can be designed in any form in accordance with the form of the guide channel 9 of the side beam 1. Further, in this embodiment, the notch 17 of the hole 15 opens to the top of the head 14. However, the position of the opening can be on a side of the head 14.

Figure 7:
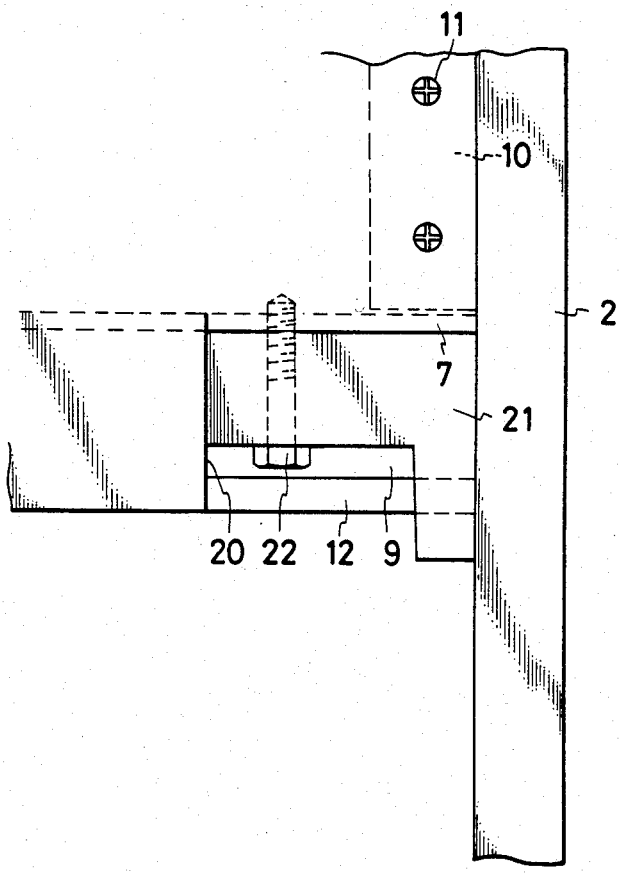
FIG. 7 is a view on an enlarged scale of the portion of FIG. 2 within the circle B.

As shown in FIGS. 2 and 7, one end of each side beam 1 has a channel opening port 20 extending from the hollow guide channel 9 and the slit opening 13 to one of the transverse faces of the side beam 1. The channel opening port 20 is sized and shaped such that the heads 14 can be moved transversely into and out of the channel opening port 20 to permit the heads 14 to be mounted on or taken off the wire rod 16. A blocking member 21 which substantially fills the channel opening port 20 during use of the heddle frame is releasably attached to the side beam 1 by bolts 22. As will be apparent, the blocking member 21 is not restricted to the structure shown, but a variety of structures can be adopted.

The replacement of heddles 5 can be quickly completed by removing the blocking member 21, forcing the wire rod 16 out through the notch 17, sliding the heads 14 longitudinally through the guide channel 9 to the channel opening port 20, and then removing the heddles 5 transversely through the channel opening port 20.

What is claimed as new and desired to be secured by Letters Patent of the United States is:

1. A heddle frame comprising:

(a) a pair of spaced side beams, each of which has a hollow guide channel in the interior thereof and a slit opening extending from said hollow guide channel to the interior face of said side beam, said slit opening being smaller in cross-sectional dimension than said hollow guide channel;

(b) a plurality of heddles disposed between said pair of spaced side beams, each of said heddles having:

(i) a head at each end which is received in the associated one of said hollow guide channels but which is sized and shaped such that it will not pass through said slit opening and (ii) a hole which passes through each of said heads in the longitudinal direction of said hollow guide channel;

(c) a wire rod disposed in each of said hollow guide channels and passing through said holes in said heads of said heddles; and (d) stoppers which are carried by each of said wire rods at each end thereof and which are sized and shaped so that they will not pass through said holes.

2. A heddle frame is recited in claim 1 wherein said heads have slots providing communication between said holes and the exterior of said heads which permits said heddles to be put on and taken off said wire rod without passing over the end of said wire rod.

3. A heddle frame as recited in claim 2 wherein said slots permit relative motion between said heads and said wire rod in a direction perpendicular to the longitudinal direction of the associated one of said hollow guide channels.

4. A heddle frame as recited in claim 2 wherein:

(a) said heads are made of a resilient material and (b) the cross-sectional area of said slots are less than the cross-sectional area of said wire rod, whereby said wire rod can be pushed through said slot against the resilience of said heads and are held in place on said wire rod.

5. A heddle frame as recited in claim 4 wherein said heads are made of plastic.

6. A heddle frame as recited in claim 1 wherein said spaced side frames are hollow, thereby reducing their weight.

7. A heddle frame as recited in claim 1 wherein said spaced side beams each contain a channel opening port extending from said hollow guide channels to the transverse faces of said side beams, said channel opening ports being sized and shaped such that said heads can be moved transversely into and out of said channel openings ports to permit said heads to be mounted on said wire rods.

8. A heddle frame as recited in claim 7 and further comprising a blocking member which is releasably attached to each of said spaced side beams to substantially fill said channel opening port.

* * * * *